US009627811B2

(12) United States Patent
Lutz et al.

(10) Patent No.: US 9,627,811 B2
(45) Date of Patent: Apr. 18, 2017

(54) LOCKING MECHANISM FOR CABLES AND CONNECTORS IN HAZARDOUS LOCATIONS

(71) Applicant: Cisco Technology, Inc., San Jose, CA (US)

(72) Inventors: Ron Lutz, Round Rock, TX (US); Art Farnsworth, Austin, TX (US); Sam D. Blackwell, Austin, TX (US); Jason Hess, Austin, TX (US); Lwin Tint, San Jose, CA (US)

(73) Assignee: Cisco Technology, Inc., San Jose, CA (US)

( * ) Notice: Subject to any disclaimer, the term of this patent is extended or adjusted under 35 U.S.C. 154(b) by 126 days.

(21) Appl. No.: 14/250,173

(22) Filed: Apr. 10, 2014

(65) Prior Publication Data

US 2015/0295353 A1 Oct. 15, 2015

(51) Int. Cl.
*H01R 13/62* (2006.01)
*H01R 13/639* (2006.01)
*H01R 13/621* (2006.01)

(52) U.S. Cl.
CPC ..... *H01R 13/639* (2013.01); *H01R 13/621* (2013.01)

(58) Field of Classification Search
CPC .... H01R 13/639; H01R 13/621; H01R 25/16; H01R 4/44; G06F 1/1616; Y10T 16/54; H02G 3/085; H02G 3/12
USPC ..... 439/306, 501, 577, 215
See application file for complete search history.

(56) References Cited

U.S. PATENT DOCUMENTS 4,293,151 A * 10/1981 Manzel ..... 285/154.2
5,197,907 A * 3/1993 Hurtgen ..... 439/810
5,348,495 A * 9/1994 Kasden ..... H01R 13/6395 439/371
5,472,355 A * 12/1995 Wittmann ..... H01R 13/6395 439/373
5,655,924 A * 8/1997 Cross ..... H01R 13/6395 439/369
5,929,383 A * 7/1999 Marik et al. ..... 174/78
5,934,919 A * 8/1999 Cross ..... H01R 13/6395 439/136
6,071,142 A * 6/2000 Blackman ..... H01R 13/6395 439/373
6,486,402 B2 * 11/2002 Harger et al. ..... 174/78
6,491,539 B1 * 12/2002 Johnston ..... H01R 13/6395 439/369
6,494,735 B1 * 12/2002 Chen ..... H01R 13/629 439/359
6,520,792 B2 * 2/2003 Chen-Chiang ..... H01R 13/6395 439/373
6,769,930 B1 * 8/2004 McDevitt, Jr. ..... H01R 13/6395 439/373
7,056,148 B2 * 6/2006 Staniszewski et al. ..... 439/444
7,470,141 B2 * 12/2008 Yoest ..... H01R 13/6392 439/369

(Continued)

*Primary Examiner* — Jean F Duverne
(74) *Attorney, Agent, or Firm* — Polsinelli PC

(57) ABSTRACT

This technology includes a device designed to retain a cable or cable connector when connected to a receptacle. The device is composed of a base bracket that interfaces with a receptacle or receptacle housing and cable bracket that interfaces with a cable or cable connector. A tool may be required to disconnect the brackets or free the cable from the receptacle.

24 Claims, 6 Drawing Sheets

(56) References Cited

U.S. PATENT DOCUMENTS

| | | | | |
|---|---|---|---|---|
| 7,695,305 | B1 * | 4/2010 | Ray | H01R 13/6395 439/359 |
| 7,722,380 | B1 * | 5/2010 | West | H01R 13/6395 439/373 |
| 7,758,371 | B2 * | 7/2010 | Carmitchel | H01R 13/6275 439/363 |
| 7,762,831 | B2 * | 7/2010 | Lin | H01R 13/6395 439/157 |
| 7,927,126 | B1 * | 4/2011 | Bender | H01J 37/04 439/369 |
| 8,337,236 | B2 * | 12/2012 | Shu | H01R 13/6395 439/369 |
| 8,460,015 | B2 * | 6/2013 | Deno et al. | 439/98 |
| 8,723,045 | B2 * | 5/2014 | Strahm, Jr. | 174/135 |
| 8,899,998 | B2 * | 12/2014 | Pyron | 439/100 |
| 8,979,557 | B2 * | 3/2015 | Dinh | H02G 3/0691 174/78 |
| 2004/0166718 | A1 * | 8/2004 | Yoest | H01R 13/6392 439/369 |
| 2013/0097812 | A1 * | 4/2013 | Sanders | H01R 13/639 24/115 R |
| 2013/0183855 | A1 * | 7/2013 | Warner | H01R 13/6395 439/536 |

* cited by examiner

LOCKING MECHANISM FOR CABLES AND CONNECTORS IN HAZARDOUS LOCATIONS

TECHNICAL FIELD

The present technology relates generally to a mechanism for retaining a cable or connector.

BACKGROUND

Computers and other electronic devices often use cables to communicate to and from accessories, other devices, and networks. These cables provide a pathway for transmission of signals, such as optical signals, electrical signals, and power (electric voltage and current). The cables typically interface with computers and other electronic devices via a cable connector that is present on the ends of the cable. In some instances, the same design of cable connector is on both ends of a cable. In other instances, each end has a different cable connector.

For the cable connector to interface with the computer or electronic device, a receptacle is typically present on the computer or electronic device. The cable connector mates with the receptacle to provide an electrical connection between the cable and device. Commonly, the cable connector is of a male design, while the receptacle is a female design.

Disconnecting a cable connector from a receptacle can result in a spark or shock. This is more likely to occur when a signal or power is being transmitted through the cable, where the likelihood is a function of electrical voltage.

BRIEF DESCRIPTION OF THE DRAWINGS

Certain features of the subject technology are set forth in the appended claims. However, the accompanying drawings, which are included to provide further understanding, illustrate disclosed aspects and together with the description serve to explain the principles of the subject technology. Understanding that these drawings depict only example embodiments of the disclosure and are not, therefore, to be considered to be limiting of its scope, the principles, herein, are described and explained with additional specificity and detail through the use of the accompanying drawings, in which:

DETAILED DESCRIPTION

Figure 1A:
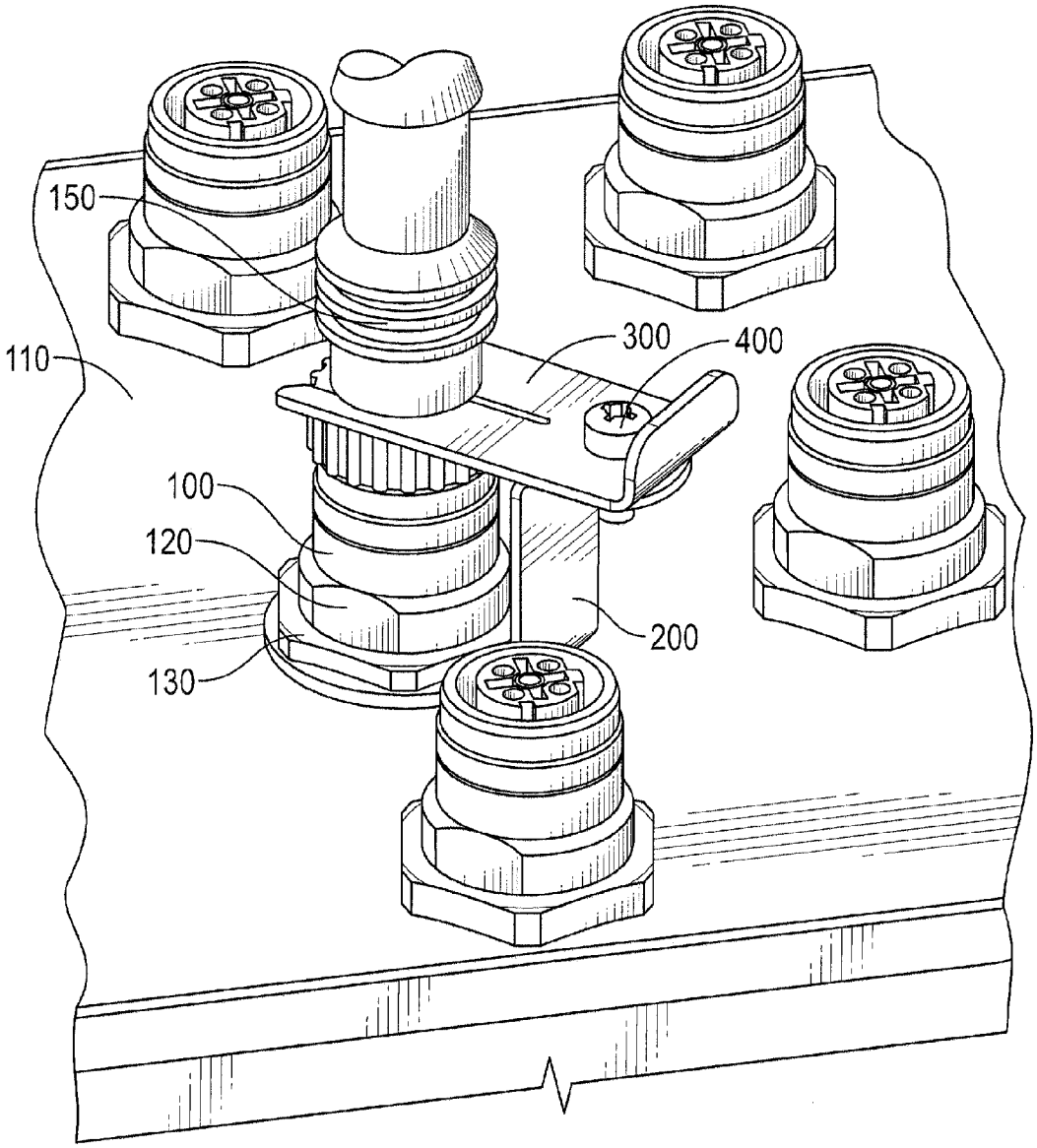
FIG. 1A is an example graphical projection of an assembled base bracket and cable bracket onto a M8/M12-style connector and cable.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a more thorough understanding of the subject technology. However, it will be clear and apparent that the subject technology is not limited to the specific details set forth herein and may be practiced without these details. A person skilled in the relevant art will recognize that other components and configurations may be used without parting from the spirit and the scope of the disclosure. In some instances, structures and components may be shown in block diagram form in order to avoid obscuring the concepts of the subject technology.

Overview:

The disclosed technology addresses the need for a locking mechanism for cables and connectors. The present technology may be utilized for components present in hazardous locations. It may also be retrofitted onto pre-existing equipment in such hazardous locations. The disclosed technology addresses the need in the art for a locking cable connector system that requires a tool to be removed and can be retrofitted onto existing hardware. Thus, this technology could meet the requirements to be utilized in hazardous locations. The present technology includes a base bracket and cable bracket. The base bracket interfaces with a receptacle or receptacle housing, the cable bracket interfaces with a cable connector, and the base bracket and cable bracket interface with each other. One or more of these interfaces may require a tool to separate the two elements. Several possible embodiments of the present technology are disclosed herein. However, the described embodiments are not meant to be limiting, and persons of ordinary skill in the art will appreciate many potential variations that are within the level of skill in the art. Further, while aspects of the present technology will be described as embodiments, it will be appreciated that aspects of one embodiment are usable with other embodiments, and such is explicitly contemplated herein.

Analysis:

As mentioned, disconnecting a cable connector from a receptacle can result in a spark or shock. For a computer in a standard office environment, this generally does not pose a significant problem, as power is often limited to between 5-20 volts DC. However, in some environments, such as coal mines, petroleum plants, fiber and textile plants, or flour mills, the potential for ignition of flammable products like gas, dust, or fibers is significant. In these situations, a small, seemingly innocuous spark or arc can result in ignition and even an explosion. Thus, it is critical that cables are not accidentally or voluntarily disconnected during inappropriate situations.

To prevent accidental disconnections, some connectors have a manual retention mechanism. A VGA display connection is such an example, as it commonly uses dual thumbscrews, one on each side of the connector. These thumbscrews can be manually engaged to the receptacle housing to prevent accidental disconnections. Some connectors even have an automatic retention feature, such as 8P8C modular connector used with CAT5 or CAT6 computer network cable (commonly referred to as RJ45), which typically has a clip that automatically locks when the network cable connector is inserted in to the appropriate receptacle. While at least somewhat effective against accidental disconnections, these mechanisms permit easy disconnection by anyone simply using one or two hands.

The International Electrotechnical Commissions creates a standard that all cable connectors within a hazardous location require a tool to remove a connector from a receptacle. (See EN/IEC 60079-0 and the various sub-standards, such as 60079-15). Elements outlined in this standard specify prevention of accidental disconnection, and, for voluntary disconnection, requiring an extra procedure of utilizing a tool to perform the separation of the cable connector from the receptacle.

To address this, Molex, which is one of the leading suppliers of connectors and interconnect components, created a custom connector, the "Ultra Lock" series. These connectors incorporate a mechanical lock to prevent accidental disconnection and have a radial seal to prevent ingress of contaminants. However, they do not require a tool to remove, as the "push-to-lock" technology can be actuated by hand. In addition, these connectors require both a custom cable and receptacle in order to incorporate the features. This is costly and problematic for locations that already have functioning equipment but simply want to upgrade the existing equipment to add the locking safety feature.

Cable and Connector Locking Mechanism:

FIG. 1A illustrates an example locking mechanism for a cable connector and receptacle. The apparatus is comprised of two primary components, a base bracket 200 and a cable bracket 300. The apparatus is shown in a locked configuration for an M8/M12 style connector. That is, as shown in FIG. 1A, the apparatus prevents the M8 cable connector from disconnecting from the M8 receptacle.

A typical M8 connector utilizes two separate motions to attach and remove from a receptacle. First, an axial force must be applied to engage the electrical pins with the electrical receptacles. Second, a rotation of a collar engages internal screw threads on the cable connector with external screw threads on the receptacle. This threaded feature increases the pull-off (or "retention") force. However, the collar can be "un-screwed" by hand, which leaves the cable vulnerable to accidental or voluntary disconnection.

The addition of a locking apparatus adds an additional layer of safety. To remove the connector from the receptacle, the locking apparatus may be configured such that it must first be disconnected or removed. In the embodiment shown in FIG. 1A, a threaded fastener 400 is utilized at the interface between the base bracket 200 and cable bracket 300 to connect the two brackets. An external tool, such as a screwdriver, is required to remove the threaded fastener 400, which permits the base bracket 200 and cable bracket 300 to be disconnected and, subsequently, the cable connector to be disconnected from the receptacle.

While a threaded fastener 400 is shown in FIG. 1A, other embodiments may be utilized, as understood by one of ordinary skill in the art. For example, a cable tie could be utilized to connect the base bracket 200 and cable bracket 300, whereby the cable tie requires wire cutters or a knife to remove. As another alternative, a rivet could be utilized, which requires the rivet to be drilled out to remove.

Figure 1B:
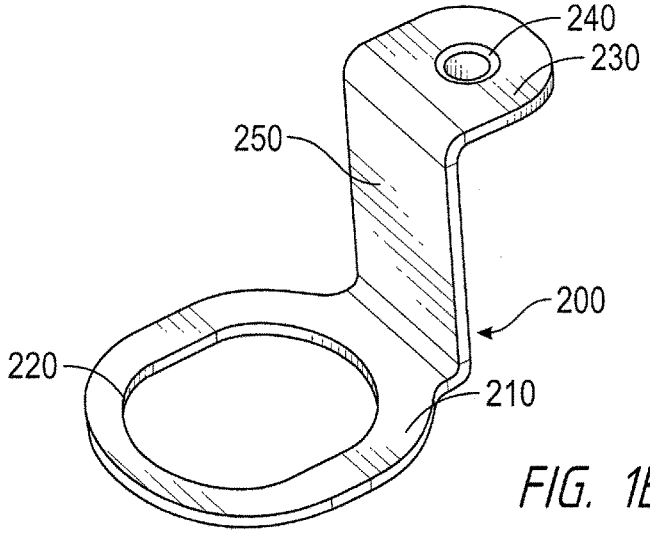
FIG. 1B is an example graphical projection of a base bracket.
Figure 1C:
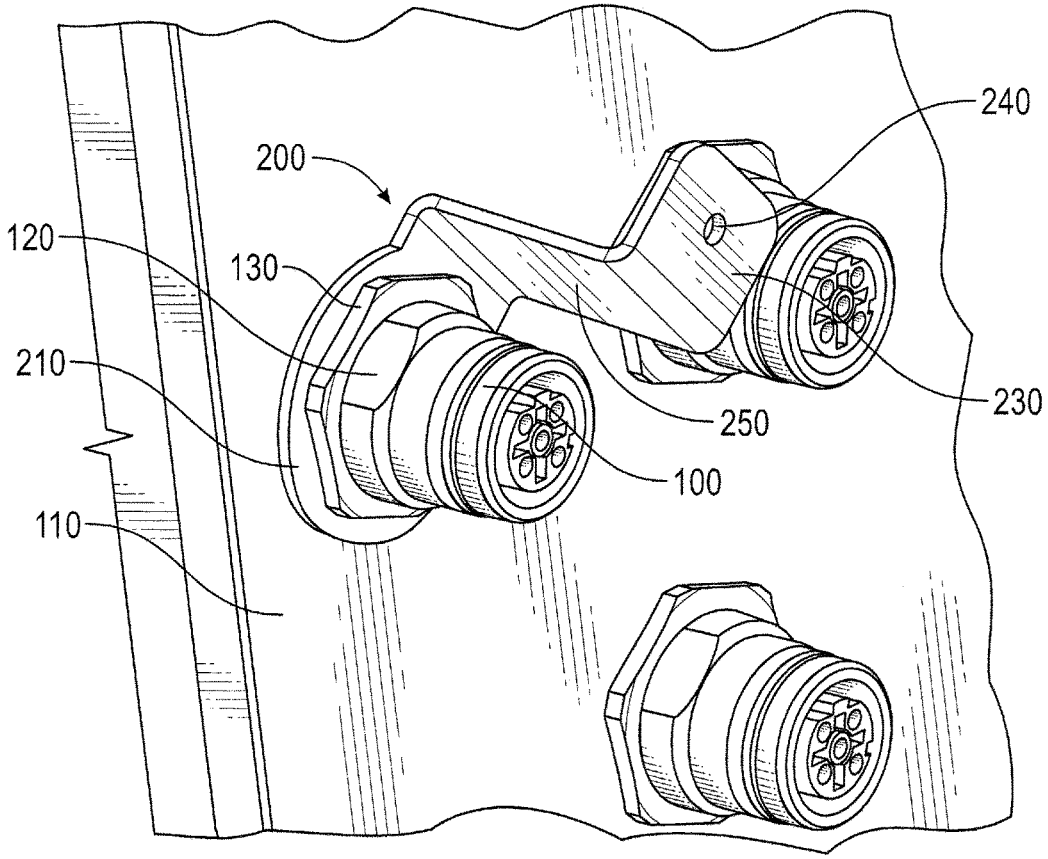
FIG. 1C is an example graphical projection of a base bracket installed onto a M8/M12-style connector.

The base bracket 200 is designed to interface with the receptacle 100 and/or receptacle housing 110. FIG. 1B illustrates an isolated view of the example base bracket. This embodiment utilizes a lower interface retainment feature 220 in the form of a double d-shaped hole that engages with a double d-shaped feature 120 on the receptacle 100, as partially shown in FIG. 1C. The double d-shaped feature creates a rotation specific alignment, where the base bracket 200 can fit onto the receptacle 100 in two orientations, 180 degrees apart in rotation. A retaining nut 130 threads onto the receptacle 100, clamping the base bracket to the receptacle housing 110. The retaining nut 130 may be a separate component or may be incorporated onto the base bracket 200. An additional feature that is not illustrated in the figures is one or more gaskets may be located and compressed between the compression nut, base bracket, and receptacle or receptacle housing to create a contaminant seal.

This embodiment of the base bracket contains an upper interface 230. The upper interface 230 has an upper interface retainment feature 240. In this embodiment, the upper interface retainment feature 240 is in the form of a hole with an attached internally-threaded nut, as illustrated in FIG. 1B. However, other embodiments are envisioned where the threaded hole can be within the primary material of the base bracket 200. Further, other embodiments are envisioned that do not use a threaded hole and fastener, but rather utilize connection mechanisms like zip ties or rivets, as described previously.

This embodiment of the base bracket contains a riser 250 that connects the lower interface 210 to the upper interface 230. The riser 250 positions the upper interface 230 nearer to the connection with the cable connector 150. The height of the riser may be a function of the size of the cable connector and where the cable bracket 300 is designed to connect to the cable connector 150. The riser 250 may be a fixed height or may be adjustable/variable to accommodate different sized cable connectors.

Figure 1D:
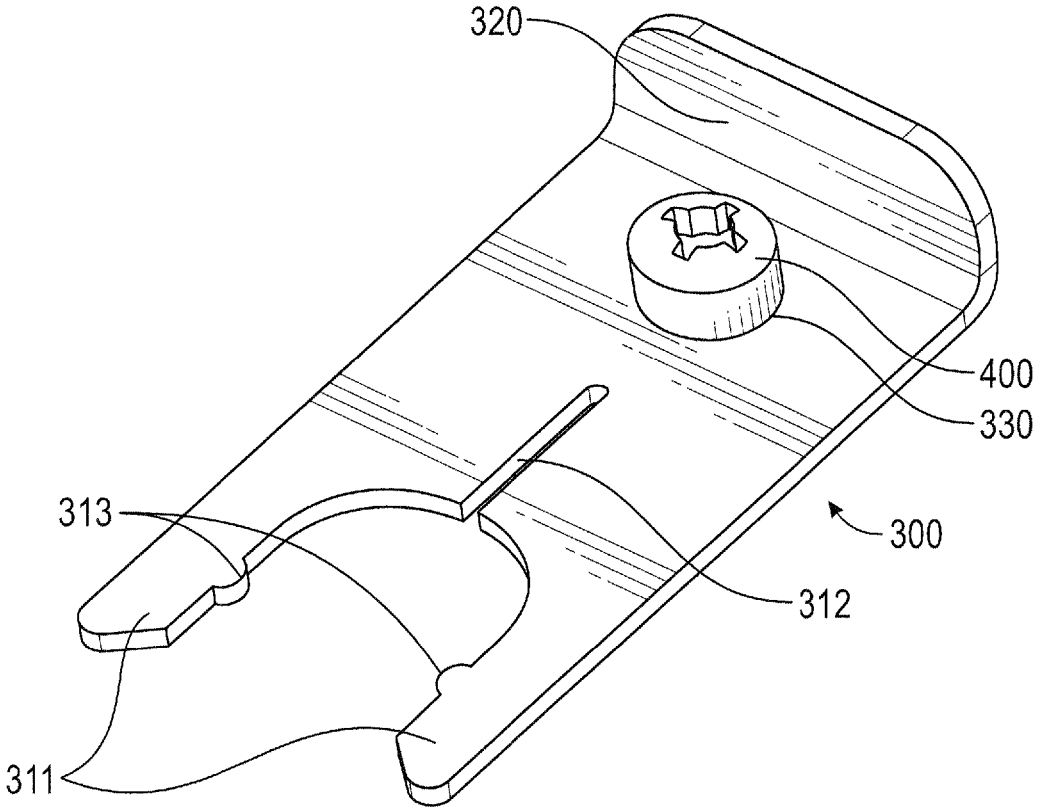
FIG. 1D is an example graphical projection of a cable bracket.

The cable bracket 300 is designed to interface with the cable connector 150 and the base bracket 200. FIG. 1D illustrates an isolated view of the example cable bracket. This embodiment of the cable bracket contains a cable engagement feature 310 in the form of an interface channel that engages with a portion of the cable connector 150. The interface channel works similar to a c-clip, whereby the arms 311 are able to spread and expand around the cable connector when exposed to an axial force. The movement of the arms is facilitated by the expansion slot 312. One or more retention nubs 313 may be present within the interface channel to help lock the cable bracket 300 to the cable connector 150, when the cable connector 150 is fully inserted into the cable engagement feature 310, as illustrated in FIG. 1A.

This embodiment of the cable bracket also contains a leverage grip 320. This leverage grip facilitates a user to provide an axial force to either engage or disengage the cable bracket 300 with the cable connector 150.

This embodiment of the cable bracket also contains a bracket retainment feature 330. In this embodiment, the feature is in the form of a simple hole that houses a captive threaded fastener 400. The threaded fastener 400 is shown with a Philips head in FIG. 1A and FIG. 1D. However, other types of threaded fasteners may be utilized, as understood by one of ordinary skill in the art. The threaded fastener 400 engages with the upper interface retainment feature 240, fastening the base bracket to the cable bracket, as illustrated in FIG. 1A.

The base bracket 200 and the cable bracket 300 may be comprised of metallic, polymeric, or rubber materials. They may be manufactured by injection molding, stamping, casting, or machining Other materials and manufacturing methods may be utilized, and the design altered to accommodate those materials, as understood by one of ordinary skill in the art.

To install the cable lock onto cable connector and receptacle, the following procedure may be utilized. If the cable connector is connected to the receptacle, the cable connector may need to be removed from the receptacle. The base bracket is attached to the receptacle and/or the receptacle housing. For the embodiment illustrated in FIGS. 1A-1D, this entails removing the retaining nut 130 from the receptacle, placing the double D-shaped lower interface retainment feature 220 around the receptacle 100 in the correct orientation so it aligns with the double d-shaped feature 120 on the receptacle 100, and reinstalling the retaining nut 130 to lock the base bracket 200 to the receptacle 100 and receptacle housing 110.

The cable bracket is then installed onto the cable connector. For the embodiment illustrated in FIGS. 1A-1D, this entails snapping the cable bracket 300 onto the M8/M12 cable connector 150.

The cable connector 150 is then connected to the receptacle. For the embodiment illustrated in FIGS. 1A-1D, this would entail providing an axial force on the M8/M12 connector to engage the receptacle and revolving the collar on the cable connector to thread onto the receptacle.

Finally, the cable bracket is connected to the base bracket. This may happen concurrently with the preceding step. For the embodiment illustrated in FIGS. 1A-1D, this entails aligning the upper interface retainment feature 240 on the base bracket 200 and the bracket retainment feature 330 on the cable bracket 300 and inserting a threaded fastener 400 which threads into the nut/threaded area on the base bracket 200.

Figure 2A:
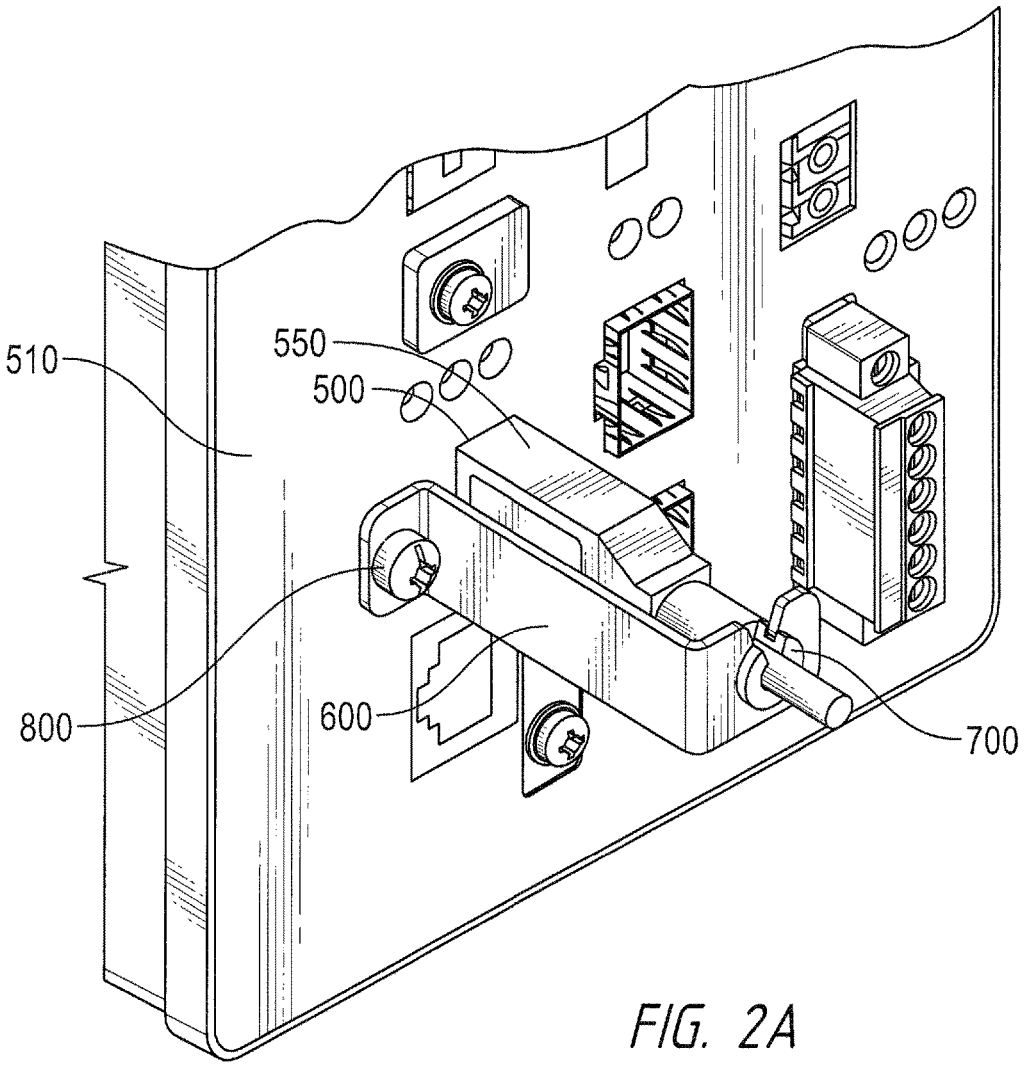
FIG. 2A is an example graphical projection of a base bracket installed onto a USB connector.

Another example embodiment is illustrated in FIGS. 2A-2D. FIG. 2A illustrates an example locking mechanism for a cable connector and receptacle. The apparatus is comprised of two primary components, a base bracket 600 and a cable bracket 700. The apparatus is shown in a locked configuration for a USB Standard-A connector. That is, as shown in FIG. 1A, the locking apparatus prevents the USB Standard-A connector from disconnecting from the USB Standard-A receptacle.

A typical USB Standard-A connector utilizes a single motion to attach and remove from a receptacle. An axial force must be applied to engage the electrical contacts of the connector with the electrical contacts of the receptacle. The connector and receptacle are only held together by the friction of the contacting components, which leaves the cable vulnerable to accidental or voluntary disconnection.

The addition of the locking apparatus adds an additional layer of safety. To remove the connector from the receptacle, the locking apparatus must be disconnected or removed. In the embodiment shown in FIG. 2A, a threaded fastener 800 is utilized at the interface between the base bracket 600 and the receptacle housing 510 to connect the two brackets. An external tool, such as a Philips screwdriver, is required to remove the threaded fastener 800, which permits the base bracket 600 to be disconnected from the receptacle housing 510 and, subsequently, the cable connector 550 to be disconnected from the receptacle 500.

A threaded fastener 800 is shown in FIG. 2A. This attachment mechanism requires that the receptacle housing 510 has a threaded hole or a through hole with a threaded nut. While the threaded fastener is illustrated in FIG. 2A, other connection apparatuses may be utilized. For example, a cable tie could be utilized to connect the base bracket 600 and receptacle housing 510, whereby the cable tie requires wire cutters or a knife to remove. As another alternative, a rivet could be utilized, which requires the rivet to be drilled out to remove.

Figure 2B:
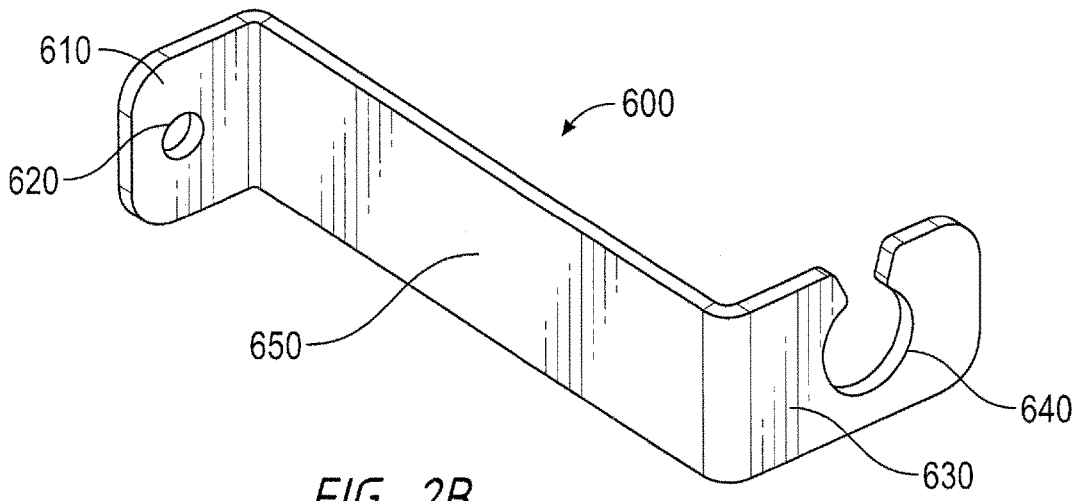
FIG. 2B is an example graphical projection of a base bracket.

The base bracket 600 is designed to interface with the receptacle housing 510. FIG. 2B illustrates an isolated view of the example base bracket. This base bracket exhibits a lower interface 610, which contains a lower interface retainment feature 620. In this example embodiment, the lower interface retainment feature 620 is in the form of a through hole for application of the threaded fastener 800. The threaded fastener 800 may be captive within the base bracket or may be fully removable. As described previously, other attachment mechanisms may be utilized in place of the threaded fastener 800. The base bracket would need to be shaped and configured accordingly to interface with the attachment mechanisms.

The base bracket also contains an upper interface 630. The upper interface 630 has an upper interface retainment feature 640 that is configured to interface with the cable bracket 700. In this embodiment, the upper interface retainment feature 640 is in the form of a hole with V-shaped channel, as illustrated in FIG. 2B. In this embodiment, the cable bracket 700 snaps into the hole of the upper interface retainment feature 640. However, other embodiments are envisioned. Another example is to utilize a second threaded fastener to connect the cable bracket 700 to the base bracket 600. Other connection options include zip ties or rivets, as described previously.

This embodiment of the base bracket contains a riser 650 that connects the lower interface 610 to the upper interface 630. The riser 650 positions the upper interface 630 nearer to the connection with the cable connector 550. The height of the riser may be a function of the size of the cable connector and where the cable bracket 700 is designed to connect to the cable connector 550. The riser 650 may be adjustable to accommodate different length cable connectors 650.

Figure 2C:
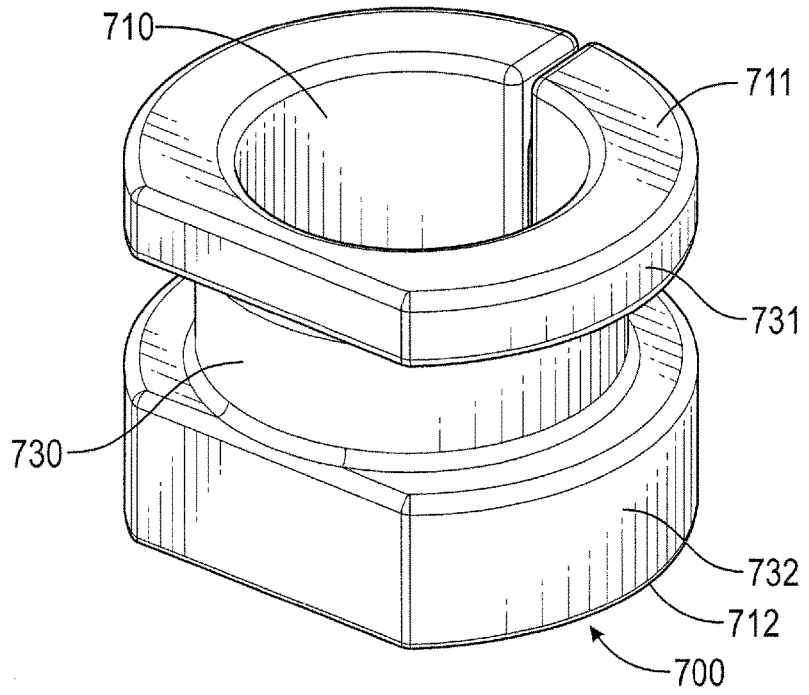
FIG. 2C is an example graphical projection of a cable bracket in the form of an asymmetrical grommet.

The cable bracket 700 is designed to interface with the cable connector 550 and the base bracket 600. FIG. 2C illustrates an isolated view of the example cable bracket. This embodiment of the cable bracket is in the form of a split grommet. It contains a cable engagement feature 710 in the form of an interface channel that engages with a portion of the cable connector 550. The split grommet design allows the grommet to be elastically stretched, so the cable can be passed through the slot in the grommet and positioned within the interface channel. The grommet is then able to elastically return to its original state with the cable or cable connector 550 inside the interface channel. In this embodiment, the cable bracket is positioned so the outer face 711 or 712 is adjacent to a size transition on the cable or cable connector 550. When the cable lock is fully assembled, as illustrated in FIG. 2A, the interface between the outer face 711 or 712 and the size transition on the cable or cable connector 550 prevents the cable connector 550 from being dislodged from the receptacle 500 and moving away from the receptacle housing 510.

This embodiment of the cable bracket also contains a bracket retainment feature 730. In this embodiment, the feature is in the form of an external channel that is sized and configured to engage with the upper interface retainment feature 640 of the base bracket 600, as illustrated in FIG. 2A.

The cable bracket can be asymmetrically designed. For example, the external channel of the bracket retainment feature 730 may not be centered, as illustrated in FIG. 2C. This configuration allows the cable bracket to be "reversible" as the thickness of spacing feature 731 is less than the thickness of spacing feature 732. When fully assembled, as shown in FIG. 2A, reversing the orientation of the cable bracket 700 can accommodate different length cable connectors due to the different thicknesses of spacing features 731 and 732. In other words, if the less thick spacing feature 731 is positioned closer to the cable connector 550, then a longer cable connector can be utilized compared to if the more thick spacing feature 731 is positioned closer to the cable connector 550. This feature can be important for connector compatibility as some connector standards, like the USB standard, have maximum sizes or a range of allowable sizes.

The base bracket 200 and the cable bracket 300 may be comprised of metallic, polymeric, or rubber materials. They may be manufactured by injection molding, stamping, casting, or machining Other materials and manufacturing methods may be utilized, and the design altered to accommodate those materials, as understood by one of ordinary skill in the art.

Figure 2D:
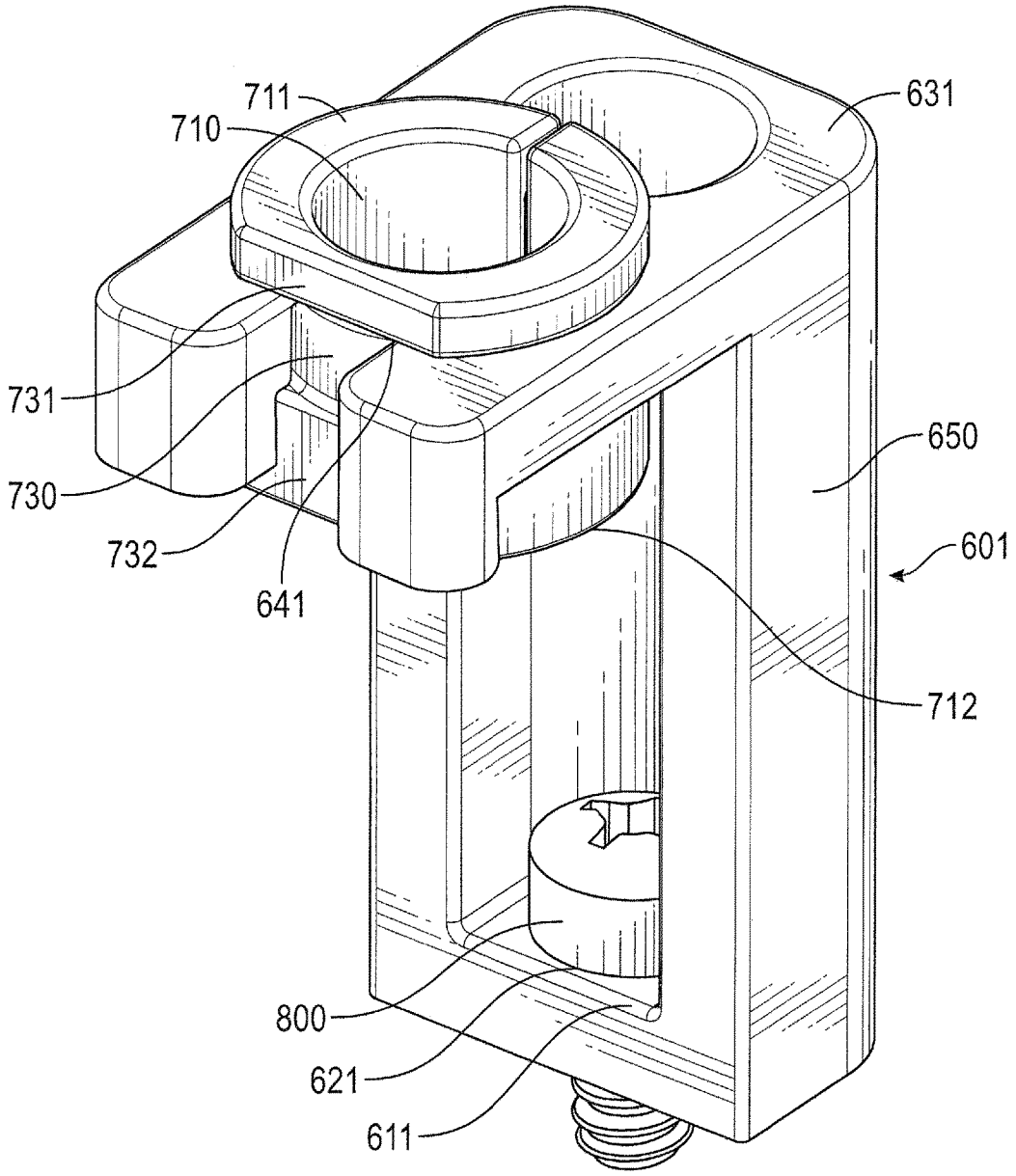
FIG. 2D is an example graphical projection of an assembled base bracket and cable bracket.

An example of a design alternation for the base bracket is illustrated in FIG. 2D. In this design, the base bracket 601 utilizes a thicker wall, which may facilitate composition from a polymeric material. Otherwise, the base bracket 601 is functionally the same. It possesses an lower interface 611, lower interface retainment feature 621, upper interface 631, upper interface retainment feature 641, and riser 651.

To install the cable lock onto cable connector and receptacle, the following procedure may be utilized. For the embodiment illustrated in FIGS. 2A-2D, the cable lock can be installed while the cable connector is still connected to the receptacle. Subsequently, the following three steps may be performed in any order. (1) The cable bracket 700 is installed onto the cable or cable connector 550 for the USB connector. (2) The bracket retainment feature 730 of the cable bracket 700 is engaged onto the upper interface retainment feature 640 of base bracket 600. (3) The base bracket 600 is engaged with the receptacle housing 510 via a threaded fastener 800, which engages a threaded are on the receptacle housing 510. A fourth step would typically be completed prior to at least one of the other preceding steps. This step entails inserting the cable connector 550 into receptacle 500 using an axial force on the USB connector.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more."

A phrase such as an "aspect" or "embodiment" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

What is claimed is:

1. A cable lock apparatus comprising:

a cable bracket with a C-shaped or circular channel configured to attach to a cable connector, the C-shaped or circular channel having a diameter less than or equal to a diameter of the cable connector; and a base bracket comprising:

a lower interface, the lower interface configured to attach the base bracket to a receptacle or receptacle housing; and an upper interface containing a circular opening, the upper interface configured to attach the base bracket to the cable bracket at the circular opening and secure the cable bracket to the receptacle or receptacle housing and prevent the cable connector from disengaging from the receptacle, wherein the upper interface and the lower interface are substantially parallel to one another.

2. The apparatus of claim 1, wherein the base bracket and cable bracket are configured such that a tool is required to separate the base bracket from the cable bracket.

3. The apparatus of claim 1, wherein the base bracket interfaces with the receptacle or the receptacle housing in a configuration where a tool is required to separate the base bracket from the receptacle or the receptacle housing.

4. The apparatus of claim 1, wherein the base bracket is configured to be connected to the receptacle housing with a threaded fastener.

5. The apparatus of claim 4, wherein the threaded fastener is captive within the base bracket.

6. The apparatus of claim 1, wherein the base bracket and cable bracket are connected and retained by a threaded fastener.

7. The apparatus of claim 1, wherein at least a portion of the base bracket is configured to be positioned around an M8 or M12 receptacle.

8. The apparatus of claim 1, wherein the base bracket is configured to be positioned behind and retained by a retention nut engaged on the receptacle.

9. The apparatus of claim 8, further comprising one or more gaskets that are configured to be compressed between the compression nut, the base bracket, and the receptacle or the receptacle housing.

10. The apparatus of claim 1, wherein the cable bracket comprises a C-shape configured to mechanically attach with the cable connector.

11. The apparatus of claim 1, wherein the cable bracket comprises a grommet configured to fit around the cable or the cable connector.

12. The apparatus of claim 11, wherein the grommet is reversible and asymmetrically shaped, such that it can accommodate different length cable connectors.

13. A system comprising:

a cable with a cable connector;

a receptacle surrounded by a receptacle housing; and a cable lock apparatus, configured to prevent the cable connector from disengaging from the receptacle, comprising:

a cable bracket with a C-shaped or circular channel configured to attach to a cable connector, the C-shaped or circular channel having a diameter less than or equal to a diameter of the cable connector; and a base bracket comprising:

a lower interface, the lower interface configured to attach the base bracket to a receptacle or receptacle housing; and an upper interface containing a circular opening, the upper interface configured to attach the base bracket to the cable bracket at the circular opening and secure the cable bracket to the receptacle or receptacle housing, wherein the upper interface and the lower interface are substantially parallel to one another.

14. The system of claim 13, wherein the base bracket and cable bracket are configured to be connected with a threaded fastener.

15. The system of claim 13, wherein at least a portion of the base bracket is configured to be positioned around an M8 or M12 receptacle.

16. The system of claim 13, wherein the base bracket is configured to be positioned behind and retained by a retention nut engaged on the receptacle.

17. The system of claim 16, further comprising one or more gaskets that are configured to be compressed between the compression nut, base bracket, and receptacle or receptacle housing.

18. The system of claim 13, wherein the base bracket and cable bracket are configured such that, when the two brackets are connected, a tool is required to separate the base bracket from the cable bracket.

19. The system of claim 13, wherein a tool is required to separate the base bracket from the receptacle or receptacle housing.

20. The system of claim 13, wherein the base bracket is configured to be connected to the receptacle housing with a threaded fastener.

21. The system of claim 20, wherein the threaded fastener is captive within the base bracket.

22. The system of claim 13, wherein the cable bracket is in the form of a C-shape that is configured to snap onto the cable connector.

23. The system of claim 13, wherein the cable bracket is in the form of a grommet that is configured to fit around the cable or cable connector.

24. The system of claim 23, wherein the grommet is reversible and asymmetrically shaped, such that it can accommodate different length cable connectors.

* * * * *